US012550991B2

(12) United States Patent
Hickey et al.

(10) Patent No.: US 12,550,991 B2
(45) Date of Patent: Feb. 17, 2026

(54) HAIRSTYLING DEVICE

(71) Applicant: Dyson Technology Limited, Wiltshire (GB)

(72) Inventors: Elizabeth Chania Hickey, Bristol (GB); Andrew Collingwood Watson, Gloucester (GB)

(73) Assignee: Dyson Technology Limited, Wiltshire (GB)

( * ) Notice: Subject to any disclaimer, the term of this patent is extended or adjusted under 35 U.S.C. 154(b) by 630 days.

(21) Appl. No.: 18/017,562

(22) PCT Filed: Jul. 21, 2021

(86) PCT No.: PCT/GB2021/051884
§ 371 (c)(1),
(2) Date: Jan. 23, 2023

(87) PCT Pub. No.: WO2022/023719
PCT Pub. Date: Feb. 3, 2022

(65) Prior Publication Data

US 2023/0292902 A1 Sep. 21, 2023

(30) Foreign Application Priority Data

Jul. 29, 2020 (GB) ..... 2011782

(51) Int. Cl.
*A45D 1/06* (2006.01)
*A45D 1/04* (2006.01)
*A45D 1/28* (2006.01)

(52) U.S. Cl.
CPC ..... *A45D 1/06* (2013.01); *A45D 1/04* (2013.01); *A45D 1/28* (2013.01); *A45D 2001/045* (2013.01)

(58) Field of Classification Search
CPC ... A45D 1/06; A45D 1/04; A45D 1/28; A45D 2001/045; A45D 2200/00; A45D 2/001
See application file for complete search history.

(56) References Cited

U.S. PATENT DOCUMENTS 4,130,955 A 12/1978 Baumgartner
4,685,229 A 8/1987 Moravek et al.
(Continued)

FOREIGN PATENT DOCUMENTS

BR 102013004145 A2 10/2014
BR 102013004142 A2 11/2014
(Continued)

OTHER PUBLICATIONS

International Search Report and Written Opinion received for PCT Patent Application No. PCT/GB2021/051874, mailed on Oct. 20, 2021, 10 pages.
(Continued)

*Primary Examiner* — Robert G Bachner
(74) *Attorney, Agent, or Firm* — Tucker Ellis LLP; Michael G. Craig

(57) ABSTRACT

A cordless hairstyling device, a method of operating the hairstyling device, and a computer program comprising a set of instructions, which, when executed causes a computerized device to perform the method is provided. The device includes a heatable hair contact member having a hair contact-able surface, the hair contact member being operable to apply heat to a tress of hair of a user via the hair contactable surface, at least one sensor configured to sense a change in state of the device from a first stationary state to a second moving state, and a controller configured to, in response to the at least one sensor sensing a change in state from the first state to the second state, cause the hair contact member to heat to a pre-determined operating temperature
(Continued)

by a pre-determined amount of time after the detected state change.

20 Claims, 3 Drawing Sheets

(56) References Cited

U.S. PATENT DOCUMENTS

| | | | |
|---|---|---|---|
| 4,745,260 | A | 5/1988 | Albinger et al. |
| 4,947,093 | A | 8/1990 | Dunstan et al. |
| 7,143,002 | B2 | 11/2006 | Hirano |
| 10,021,952 | B2 | 7/2018 | Goldman et al. |
| 10,357,092 | B2 | 7/2019 | Kustra et al. |
| 10,470,545 | B2 | 11/2019 | Thiebaut et al. |
| 10,507,587 | B2 | 12/2019 | Uit De Bulten |
| 10,596,716 | B2 | 3/2020 | Hoexum et al. |
| 10,656,604 | B2 | 5/2020 | Godlieb |
| 10,716,391 | B2 | 7/2020 | Balooch et al. |
| 10,909,881 | B2 | 2/2021 | Heitmann et al. |
| 11,574,556 | B2 | 2/2023 | Moore et al. |
| 2011/0253164 | A1 | 10/2011 | Morgandi et al. |
| 2012/0211018 | A1 | 8/2012 | deGrood |
| 2012/0227758 | A1 | 9/2012 | Ford et al. |
| 2012/0312320 | A1 | 12/2012 | Humphreys et al. |
| 2013/0312780 | A1 | 11/2013 | Rafaeli et al. |
| 2015/0101139 | A1 | 4/2015 | Guy-Rab et al. |
| 2015/0112633 | A1 | 4/2015 | Lee et al. |
| 2015/0144610 | A1 | 5/2015 | Cho |
| 2015/0201726 | A1 | 7/2015 | Prats |
| 2015/0205279 | A1 | 7/2015 | Simeth |
| 2016/0100681 | A1 | 4/2016 | Smal |
| 2016/0213117 | A1 | 7/2016 | Keong |
| 2017/0019978 | A1 | 1/2017 | Lashina et al. |
| 2017/0164708 | A1 | 6/2017 | Degrood |
| 2017/0231353 | A1 | 8/2017 | Romeo |
| 2017/0360174 | A1 | 12/2017 | Moore et al. |
| 2018/0035776 | A1 | 2/2018 | Weatherly et al. |
| 2018/0075776 | A1 | 3/2018 | Heitmann et al. |
| 2019/0045901 | A1 | 2/2019 | Kock |
| 2019/0150824 | A1 | 5/2019 | Gerhardt et al. |
| 2019/0261757 | A1 | 8/2019 | Abramov et al. |
| 2019/0307221 | A1 | 10/2019 | Whitaker et al. |
| 2019/0387856 | A1 | 12/2019 | Nowak et al. |
| 2020/0008549 | A1 | 1/2020 | Barber et al. |
| 2020/0098174 | A1 | 3/2020 | Charraud et al. |
| 2020/0146413 | A1 | 5/2020 | Mathiaszyk et al. |
| 2020/0201266 | A1 | 6/2020 | Joyce et al. |
| 2020/0217779 | A1 | 7/2020 | Brada et al. |
| 2023/0162616 | A1 | 5/2023 | Moore et al. |
| 2023/0270222 | A1 | 8/2023 | Hickey et al. |
| 2023/0292901 | A1 | 9/2023 | Hickey et al. |
| 2023/0292903 | A1 | 9/2023 | Hickey et al. |
| 2023/0309674 | A1 | 10/2023 | Hickey et al. |
| 2023/0337804 | A1 | 10/2023 | Hickey et al. |
| 2024/0008616 | A1 | 1/2024 | Hickey et al. |

FOREIGN PATENT DOCUMENTS

| | | | |
|---|---|---|---|
| CN | 1154783 | A | 7/1997 |
| CN | 101744444 | A | 6/2010 |
| CN | 202341161 | U | 7/2012 |
| CN | 202941590 | U | 5/2013 |
| CN | 103228170 | A | 7/2013 |
| CN | 204270051 | U | 4/2015 |
| CN | 104814594 | A | 8/2015 |
| CN | 105231632 | A | 1/2016 |
| CN | 205125380 | U | 4/2016 |
| CN | 105764376 | A | 7/2016 |
| CN | 107105850 | A | 8/2017 |
| CN | 107625268 | A | 1/2018 |
| CN | 108041790 | A | 5/2018 |
| CN | 207544571 | U | 6/2018 |
| CN | 110531677 | A | 12/2019 |
| CN | 111405855 | A | 7/2020 |
| CN | 212729094 | U | 3/2021 |
| DE | 4418292 | A1 | 11/1995 |
| DE | 202018005785 | U1 | 1/2019 |
| EP | 1108376 | B1 | 9/2004 |
| EP | 2359710 | A1 | 8/2011 |
| EP | 2359711 | A1 | 8/2011 |
| EP | 2510826 | A1 | 10/2012 |
| EP | 2386219 | B1 | 4/2013 |
| EP | 3228240 | A1 | 10/2017 |
| EP | 2676568 | B1 | 1/2018 |
| EP | 3460433 | A1 | 3/2019 |
| EP | 3491960 | A1 | 6/2019 |
| EP | 3429420 | B1 | 8/2019 |
| EP | 3518710 | A1 | 8/2019 |
| EP | 3573493 | A1 | 12/2019 |
| EP | 3595524 | A1 | 1/2020 |
| EP | 3629889 | A1 | 4/2020 |
| EP | 3685134 | A1 | 7/2020 |
| EP | 3386341 | B1 | 10/2020 |
| EP | 3178347 | B1 | 10/2021 |
| ES | 1029102 | U | 4/1995 |
| FR | 2942378 | B1 | 4/2014 |
| GB | 2477834 | A | 8/2011 |
| GB | 2533602 | A | 6/2016 |
| GB | 2535504 | A | 8/2016 |
| GB | 2569647 | A | 6/2019 |
| GB | 2569655 | A | 6/2019 |
| JP | 04-061804 | A | 2/1992 |
| JP | 2013-536699 | A | 9/2013 |
| JP | 2014-516742 | A | 7/2014 |
| JP | 2019-005642 | A | 1/2019 |
| KR | 10-2011-0002760 | A | 1/2011 |
| KR | 20110140038 | A | 12/2011 |
| KR | 10-1452985 | B1 | 10/2014 |
| KR | 20150060494 | A | 6/2015 |
| KR | 10-1625834 | B1 | 5/2016 |
| KR | 10-2017-0052803 | A | 5/2017 |
| KR | 10-2017-0122407 | A | 11/2017 |
| TW | 201243335 | A | 11/2012 |
| WO | 82/03520 | A1 | 10/1982 |
| WO | 2004/067829 | A1 | 8/2004 |
| WO | 2008062293 | A1 | 5/2008 |
| WO | 2010/016072 | A1 | 2/2010 |
| WO | 2010/097779 | A1 | 9/2010 |
| WO | 2012028862 | A1 | 3/2012 |
| WO | 2013/171732 | A1 | 11/2013 |
| WO | 2013/190492 | A1 | 12/2013 |
| WO | 2014/001128 | A1 | 1/2014 |
| WO | 2014001769 | A1 | 1/2014 |
| WO | 2014/076873 | A1 | 5/2014 |
| WO | 2015/043094 | A1 | 4/2015 |
| WO | 2015/067484 | A1 | 5/2015 |
| WO | 2015071656 | A1 | 5/2015 |
| WO | 2017/100229 | A1 | 6/2017 |
| WO | 2017/130192 | A1 | 8/2017 |
| WO | 2018/060232 | A1 | 4/2018 |
| WO | 2018/140085 | A1 | 8/2018 |
| WO | 2018/167073 | A1 | 9/2018 |
| WO | 2018/219899 | A1 | 12/2018 |
| WO | 2019/057575 | A1 | 3/2019 |
| WO | 2019/122850 | A1 | 6/2019 |
| WO | 2019122838 | A1 | 6/2019 |
| WO | 2019/129875 | A1 | 7/2019 |
| WO | 2019/154662 | A1 | 8/2019 |
| WO | 2020/131472 | A1 | 6/2020 |
| WO | 2020120348 | A1 | 6/2020 |
| WO | 2022/023708 | A1 | 2/2022 |
| WO | 2022/023709 | A1 | 2/2022 |
| WO | 2022/023711 | A1 | 2/2022 |
| WO | 2022/023718 | A1 | 2/2022 |

OTHER PUBLICATIONS

International Search Report and Written Opinion received for PCT Patent Application No. PCT/GB2021/051873, mailed on Oct. 19, 2021, 10 pages.

(56) References Cited

OTHER PUBLICATIONS

International Search Report and Written Opinion received for PCT Patent Application No. PCT/GB2021/051876, mailed on Oct. 11, 2021, 9 pages.
International Search Report and Written Opinion received for PCT Patent Application No. PCT/GB2021/051879, mailed on Oct. 19, 2021, 9 pages.
International Search Report and Written Opinion received for PCT Patent Application No. PCT/GB2021/051883, mailed on Oct. 7, 2021, 9 pages.
Sebastian O.H. Madgwick, "An efficient orientation filter for inertial and inertial/magnetic sensor arrays", University of Bristol, Apr. 30, 2010, pp. 1-32.
Rohm Semiconductor, "Applications for Hall Effect IC Switches in Portable Applications", Hall Effect ICs in Portable Electronics, 2008, 8 pages.
International Search Report and Written Opinion received for PCT Patent Application No. PCT/GB2021/051875, mailed on Oct. 7, 2021, 9 pages.
International Search Report and Written Opinion received for PCT Patent Application No. PCT/GB2021/051881, mailed on Nov. 4, 2021, 9 pages.
International Search Report and Written Opinion received for PCT Patent Application No. PCT/GB2021/051882, mailed on Oct. 25, 2021, 12 pages.
International Search Report and Written Opinion received for PCT Patent Application No. PCT/GB2021/051884, mailed on Nov. 5, 2021, 9 pages.
International Search Report and Written Opinion received for PCT Patent Application No. PCT/GB2021/051877, mailed on Oct. 27, 2021, 9 pages.
International Search Report and Written Opinion received for PCT Patent Application No. PCT/GB2021/051878, mailed on Oct. 15, 2021, 10 pages.
International Search Report and Written Opinion received for PCT Patent Application No. PCT/GB2021/051880, mailed on Oct. 22, 2021, 11 pages.
Search Report received for GB Application No. 2011770.1, mailed on Oct. 19, 2020, 1 page.
Search Report received for GB Application No. 2011772.7, mailed on Oct. 20, 2020, 2 page.
Search report received for GB Application No. 2011777.6, mailed on Oct. 19, 2020, 1 page.
Search Report received for GB Application No. 2011782.6, mailed on Nov. 9, 2020, 1 page.
Search Report received for GB Application No. 2011774.3, mailed on Oct. 19, 2020, 1 page.
Search Report received for GB Application No. 2011776.8, mailed on Oct. 20, 2020, 2 pages.

HAIRSTYLING DEVICE

CROSS-REFERENCE TO PRIOR APPLICATION

This application is a § 371 National Stage Application of PCT International Application No. PCT/GB2021/051884 filed Jul. 21, 2021, which claims the priority of United Kingdom Application No. 2011782.6, filed Jul. 29, 2020, each of which are herein incorporated by reference in their entirety.

TECHNICAL FIELD

The present disclosure concerns a hairstyling device. In particular, but not exclusively, the present disclosure concerns measures, including methods, apparatus and computer programs for operating a hairstyling device.

BACKGROUND

Hairstyling devices, also referred to as hairstyling appliances, are used to form hair into desired shapes or styles. In particular, heated hairstyling devices use the action of heat, and optionally also mechanical means, to style the hair in a desired manner.

An example of such a hairstyling device is a hair straightening device (also referred to as a hair straightener, or hairstyling iron). Such a hairstyling device typically comprises two articulated arms which are pivotally attached to each other at one end, and to which one or more heatable plates are attached. Where both arms have a heatable plate, the heatable plates are generally positioned on inner opposed surfaces of the arms. The heatable plates have hair-contactable surfaces which are operable to come into contact with, and apply heat to, hair during use of the hairstyling device. The heatable plates (and thus the hair-contactable surfaces) may be heated by one or more heating elements. Hair curlers, or curling tongs are other examples of a hairstyling device. A curler may comprise a heatable curved plate or barrel. An outer surface of the heatable plate or barrel may be a hair-contactable surface. A hair curler may comprise an articulated arm for clamping hair against the hair-contactable surface.

Hairstyling devices may be mains powered, or may be cordless. Cordless devices are popular with users as they allow for greater flexibility and versatility in use of the device. Cordless hairstyling devices will generally comprise an internal, rechargeable battery. The rechargeable battery will supply power to the device for a period of time, referred to herein as the run time, but will need to be recharged in-between uses, by connecting the device or the battery to a mains power supply. This can be problematic for a user, for example, if they intend to use the device for a long period of time without having access to a charging point. The run time of the device can vary depending on how the user uses the device. This can also be problematic for the user, as they may not be able to predict when the device will need to be recharged.

It is therefore desirable to provide an improved hairstyling device, improved methods of operating a hairstyling device, and/or improved run times of hairstyling devices between charges.

SUMMARY

According to an aspect of the present disclosure, there is provided a cordless hairstyling device comprising a heatable hair contact member having a hair contact-able surface, the hair contact member being operable to apply heat to a tress of hair of a user via the hair contactable surface; at least one sensor configured to sense a change in state of the device from a first stationary state to a second moving state; and a controller configured to, in response to the at least one sensor sensing a change in state from the first state to the second state, causing the hair contact member to heat to a pre-determined operating temperature by a pre-determined amount of time after the detected state change.

In embodiments, heating of the hair contact member only commences when a user moves the device, and the device will be at the desired operating temperature by the time the user starts to style their hair using the device. Conventional hair styling devices begin to heat when switched on, and dump heat when they come into contact with a tress of hair. The controlled heating claimed in the present invention is more efficient, and results in less damage to hair. In embodiments, if the device is switched on but is not moving, the controller does not cause the hair contact member to heat, thereby saving battery power and improving the run time of the device. This is more efficient, than, for example, immediately causing the hair contact member to heat to the desired operating temperature when the device is switched on. The device may not be at the required operating temperature until the moment immediately before a user begins to style their hair. This may improve the run time of the device as causing the hair contact members to be held at the operating temperature for a longer time, when the device is not being used to style the hair, will drain the charge of the device faster.

In embodiments, the controller is configured to cause the hair contact member to start heating when the at least one sensor senses the state change.

In embodiments, the controller causes the hair contact member to start heating immediately when the sensor senses that the user has moved the device, thereby allowing the hair contact member to heat gradually as the user moves the device towards the roots of their hair to begin styling.

In embodiments, the controller is configured to cause the hair contact member to start heating after a pre-determined time delay.

In embodiments, when the sensor senses that the user has moved the device, the hair contact member initially remains at room temperature, but heats rapidly to the operating temperature as the hair contact member approaches the roots of the user's hair. This further improves the run time of the device, as the hair contact members will remain at room temperature for a longer period of time prior to heating.

In embodiments, the controller is configured to cause the hair contact member to heat at a pre-determined rate.

In embodiments, the pre-determined rate is set by the manufacturer, and may be based on a predicted time that it will take for a user to move the device to the root of their hair. By causing the hair contact member to heat at a pre-determined rate, the controller may cause the hair contact member to only reach the pre-determined operating temperature immediately before a user begins to style their hair. This avoids the need for the hair contact members to be held at a high temperature when a user is not styling their hair. This further improves the run time of the device.

In embodiments, at least one of the predetermined amount of time; pre-determined rate; pre-determined time-delay; and pre-determined operating temperature is initially set to a default value.

In embodiments, at least one of the pre-determined amount of time, the pre-determined rate, the pre-determined time delay and the pre-determined operating temperature is set by the manufacturer, based on predicted desired user values and/or known safe values. For example, the pre-determined operating temperature may be a known appropriate temperature for curling and/or straightening hair. This helps to ensure that the device performs well, or optimally for a user from first use.

In embodiments, the at least one sensor is configured to output signals dependent on movement of the hairstyling device, and the controller is configured to; receive the output signals from the at least one sensor, identify one or more user operation parameters associated with how a user operates the device; and adapt, on the basis of the one or more identified user parameters, at least one of the: pre-determined amount of time; pre-determined rate; pre-determined time-delay; and the pre-determined operating temperature.

In embodiments, the sensor may output a signal indicating that the user is curling or straightening their hair, and the controller may adapt the operating temperature to be appropriate for this action. This improves the performance of the device and the user experience by ensuring that the operating temperature is appropriate for the action that is being performed. This assists in avoiding damage to the user's hair by ensuring that the device is being used at an appropriate operating temperature. In embodiments, the sensor senses that the user takes a significantly longer or shorter amount of time to move the device to the roots of their hair. The controller may adapt the heating rate, or for example, incorporate/increase or eliminate/reduce a time delay. This both improves the user experience, by ensuring that the hair contact member is at the required operating temperature when the user begins to style their hair, and improves the run time of the device by avoiding the hair contact member from being held at a high temperature for longer than necessary.

In embodiments, the controller is configured to identify one or more user operation parameters specific to multiple users, and the adaption is performed on the basis of the user specific operation parameters.

The device may be used by multiple users at different times. Different users may use the device for different styling actions, which may require different operating temperatures, and may take different amounts of time to move the device to the roots of their hair. It may therefore be appropriate for the controller to cause heating of the device to different temperatures, at different rates for the different users, in order to improve user experience and efficiency of the device. To facilitate this, the controller may identify different operating parameters for the different users.

In embodiments, the identified one or more user operation parameters comprise one or more of temporal parameters; spatial parameters; and thermal parameters.

In embodiments, the at least one sensor is configured to sense a change in state of the device from the second moving state to the first stationary state, and the controller is configured to, in response to the at least one sensor sensing a change in state from the second state to the first state, prohibit heating of the hair contact member, thereby allowing the hair contact member to cool below the pre-determined operating temperature. In embodiments, the at least one sensor is configured to sense when the hair contact member is not in contact with a tress, and the controller is configured to, in response to the at least one sensor sensing that the hair contact member is not in contact with a tress, prohibit heating of the hair contact member, thereby allowing the hair contact member to cool below the pre-determined operating temperature.

In embodiments, the sensor senses when a user has finished styling their hair and has returned the device to the stationary state. In response to receiving a signal from the sensor, the controller may stop causing the hair contact member to heat or may prohibit heating of the hair contact member. This ensures that the hair contact member is not held at the operating temperature for longer than necessary, thereby improving run time of the device. In embodiments, the controller causes the hair contact member to be held at a standby temperature until the device is switched off by the user. This ensures that the hair contact member can efficiently be caused to heat to the operating temperature if the user moves the device and wishes to continue styling their hair.

In embodiments, the at least one sensor comprises a touch sensor configured to sense when a user has picked up the device, and the controller is configured to, in response to the touch sensor sensing that the device is not being held by the user, prevent the hair contact member from heating to the pre-determined operating temperature.

In embodiments, if the device is moving but the touch sensor senses that the device is not being held by a user, the controller prevents the hair contact member from heating. This provides a safety check, ensuring that if the device has been unintentionally moved, for example, if it has been knocked off a surface by a user, the hair contact member will not heat to the pre-determined operating temperature. In other words, in embodiments, the hair contact member will only heat to the pre-determined operating temperature when the device is being used by a user for styling their hair.

In embodiments, the at least one sensor comprises an inertial measurement unit, IMU sensor, configured to sense when the device is in the second moving state. In embodiments, the IMU sensor is configured to sense when the device has been returned to the first, stationary state.

In embodiments, the at least one sensor comprises a proximity sensor, configured to sense when styling of a tress has started, and/or when styling of a tress has finished.

In embodiments, the device comprises at least one other sensor configured to sense one or more environmental conditions, and the controller is configured to cause heating of the hair contact member to the pre-determined operating temperature further on the basis of the sensed environmental conditions. In embodiments, the environmental conditions comprise temperature and/or humidity of a room in which the device is being operated.

Humidity levels and/or the temperature of the room in which the device is being used may affect the appropriate operating temperature of the device. For example, at a high humidity level, a higher operating temperature may be required. By adapting the pre-determined operating temperature on the basis of the environmental conditions in which the device is being used according to embodiments, user experience is improved, ensuring that the hair contact members are at the optimum operating temperature.

In embodiments, the pre-determined operating temperature is user-configurable.

A user may wish to override the pre-determined operating temperature set by the controller, for example, if they intend to use the device for different styling behaviour. Similarly, a user may wish to override the pre-determined heating rate set by the controller, for example, if they intend to use the device for different styling behaviour. User experience may be improved by allowing this option to control the operating characteristics of the device.

In embodiments, the device comprises a hair straightener. In embodiments, the device comprises a hair curler. A user can use the straightener to perform a curling or straightening action, and may use the device differently, requiring different operating temperatures and/or heating rates for these different actions.

In embodiments, the device comprises a heating element operable to heat the hair contact member, and the controller is configured to control the heating element to cause the heating element to heat to a pre-determined operating temperature by a pre-determined amount of time after the detected state change.

In embodiments, the hair contact member is operable to apply heat to a tress of hair via the hair-contactable surface by the movement of the contact member along the tress of hair between a hair-root end of the tress and a hair-tip end of the tress.

According to an aspect of the present disclosure, there is provided a method of operating a cordless hairstyling device, the method comprise generating a sensor signal in response to a user moving the device from a first stationary state to a second moving state, at a controller, processing the sensor signal to determine that the device is in use, and in response to determining that the device is in use, causing a heatable hair contact member to heat to a pre-determined operating temperature by a pre-determined amount of time after the detected state change.

According to an aspect of the present disclosure, there is provided a computer program product comprising a set of instructions, which, when executed by a computerized device, cause the computerized device to perform a method of facilitating use of a cordless hairstyling device, the method comprising generating a sensor signal in response to a user moving the device from a first stationary state to a second moving state; at a controller processing the sensor signal to determine that the device is in use; and in response to determining that the device is in use, causing a heatable hair contact member to heat to a pre-determined operating temperature by a pre-determined amount of time after the detected state change.

It will of course be appreciated that features described in relation to one aspect of the present invention may be incorporated into other aspects of the present invention. For example, a method of the invention may incorporate any of the features described with reference to an apparatus of the invention and vice versa.

BRIEF DESCRIPTION OF THE DRAWINGS

Embodiments of the present disclosure will now be described by way of example only with reference to the accompanying drawings, of which.

DETAILED DESCRIPTION

Figure 1A:
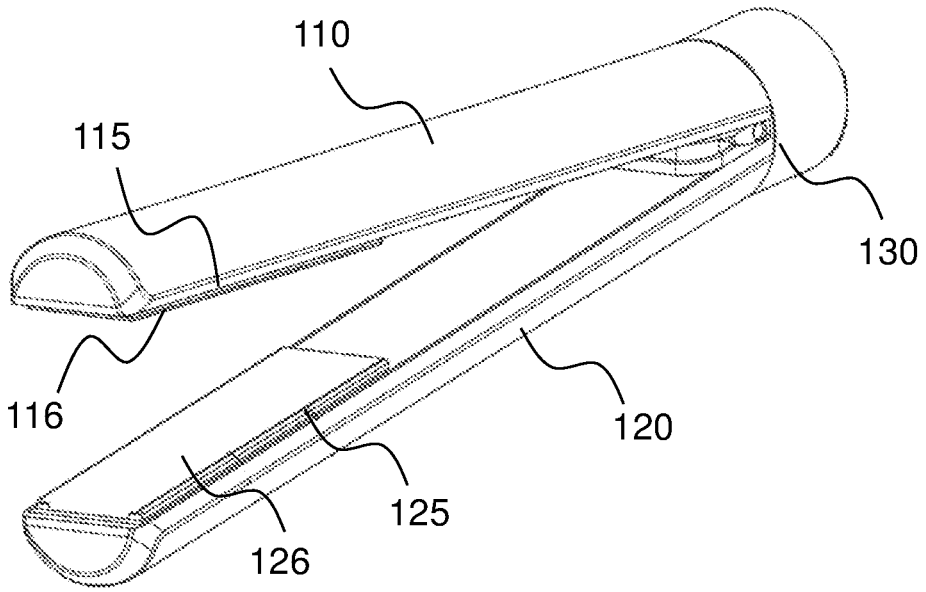
FIG. 1A is a perspective view of a cordless hairstyling device with arms in an open position, according to embodiments.
Figure 1B:
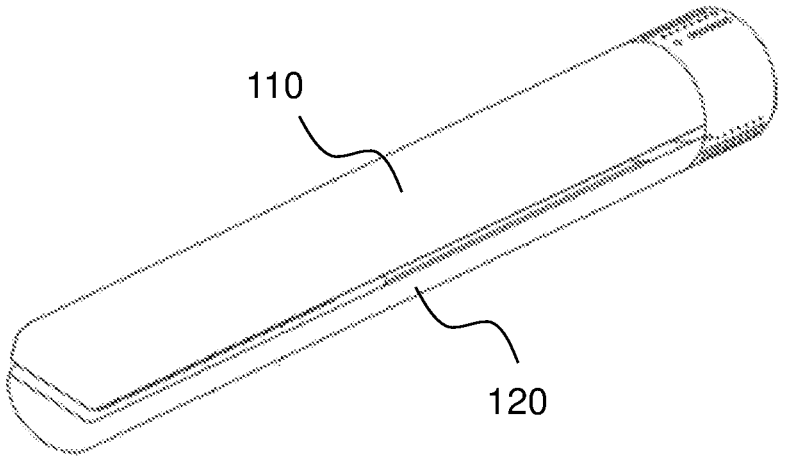
FIG. 1B is a perspective view of the cordless hairstyling device of FIG. 1A with arms in a closed position, according to embodiments.

FIGS. 1A and 1B show perspective views of a hairstyling device 100 according to embodiments. The hairstyling device 100, and/or components thereof, may be used to implement the methods described herein. In the embodiments shown in FIGS. 1A and 1B, the hairstyling device 100 comprises a hair straightener.

The hairstyling device 100 comprises a first arm 110 and a second arm 120, which are joined together at one end by a hinge 130. The hairstyling device 100 comprises a heatable hair contact member. In the embodiments shown in FIGS. 1A and 1B, each arm 110, 120 comprises a heatable hair contact member in the form of a heatable plate 115, 125. In embodiments, one or both of the heatable plates 115, 125 are heatable, e.g. by a heating element (not shown). In some embodiments, one or both of the heatable plates 115, 125 comprises a resistive plate. Such resistive plates may be heated directly, e.g. without requiring a separate heating element. Each heatable plate 115, 125 is operable to apply heat to a tress of hair of a user via a hair-contactable surface 116, 126. The hair-contactable surfaces 116, 126 are arranged such that they face each other. In embodiments, the heatable plates 115, 125 comprise ceramic or metal plates. In embodiments, the heatable plates 115, 125 comprise planar hair-contactable surfaces 116, 126. In embodiments, the heatable plates 115, 125 comprise curved or concave hair-contactable surfaces. The arms 110, 120 are hinged such that they can move between an open position (as shown in FIG. 1A), and a closed position (as shown in FIG. 1B). In the closed position, the hair-contactable surfaces 116, 126 are brought towards each other such that hair to be styled can be held between the hair-contactable surfaces 116, 126. In some embodiments, the hair-contactable surfaces 116, 126 are brought into contact when the arms 110, 120 are in the closed position. In other embodiments, the hair-contactable surfaces 116, 126 are not brought into contact.

The arms 110, 120 may be moved between the open position and the closed position by a user. For example, the user presses the arms 110, 120 together when using the hairstyling device 100 (in order to style hair between the hair-contactable surfaces 116, 126), and releases the arms 110, 120 and/or pulls the arms 110, 120 apart when styling is complete. In embodiments, the hairstyling device 100 comprises biasing means (not shown), e.g. one or more springs and/or magnets. The biasing means urge the arms 110, 120 towards the open position, such that the arms 110, 120 revert to the open position when a user is not pressing the arms 110, 120 together.

In alternative embodiments, the arms 110, 120 are not pivotable about a hinge 130. For example, the arms 110, 120 may be substantially parallel to one another. In either case, a user may press the arms 110, 120 together to style hair.

In embodiments, the heatable plates 115, 125 are operable to apply heat to a tress of hair via the hair-contactable surfaces 116, 126 by the movement of the heatable plates 115, 125 along the tress of hair between a hair-root end of the tress and a hair-tip end of the tress. In embodiments a tress may be clamped between two hair-contactable surfaces 116, 126, and the device may be drawn along the length of the tress.

The hairstyling device 100 comprises a cordless hairstyling device. For example, in embodiments the hairstyling device 100 may be powered by a rechargeable battery.

Figure 2:
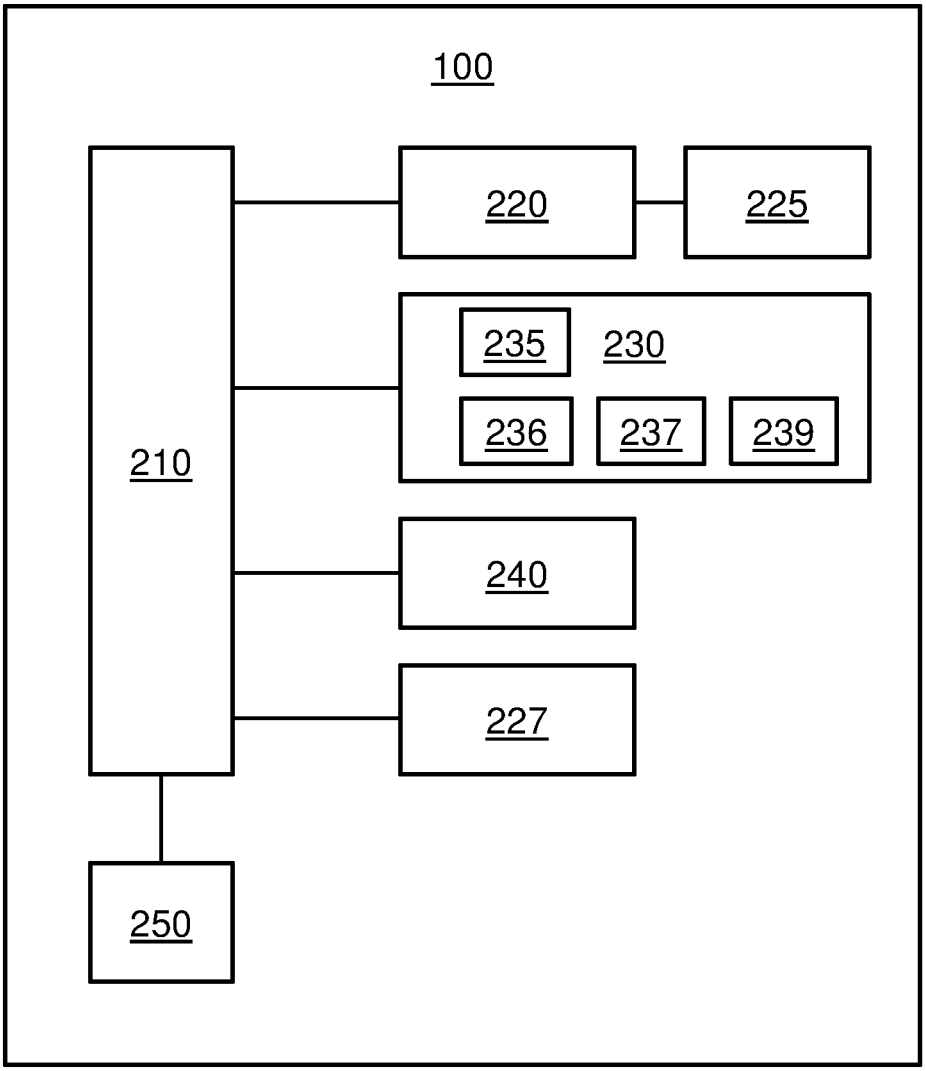
FIG. 2 is a schematic diagram of a hairstyling device according to embodiments.

FIG. 2 shows a schematic block diagram of the hairstyling device 100, according to embodiments.

The hairstyling device 100 comprises a controller 210. The controller 210 is operable to perform various data processing and/or control functions according to embodiments, as will be described in more detail below. The controller 210 may comprise one or more components. The one or more components may be implemented in hardware and/or software. The one or more components may be co-located or may be located remotely from each other in the hairstyling device 100. The controller 210 may be embodied as one or more software functions and/or hardware modules. In embodiments, the controller 210 comprises one or more processors configured to process instructions and/or data. Operations performed by the one or more processors may be carried out by hardware and/or software. The controller 210 may be used to implement the methods described herein. In embodiments, the controller 210 is operable to output control signals for controlling one or more components of the hairstyling device 100.

In embodiments, causing the hair contact member 225 to heat comprises supplying power to the hair contact member 225. In embodiments, power is supplied to the hair contact member by a rechargeable battery. In embodiments, causing the hair contact member 225 to heat comprises applying a voltage across the hair contact member 225. In embodiments, the hair contact member 225 comprises a resistive plate.

In embodiments, the hairstyling device 100 comprises a heating element 220. The heating element 220 may, for example, be operable to convert electrical energy into heat. The heating element 220 is configured to cause hair to be heated by the hairstyling device 100. The controller 210 is operable to control the heating element 220. For example, the controller 210 may be operable to apply energy (e.g. electrical energy) to the heating element 220, e.g. via one or more control signals generated by the controller 210.

The hairstyling device comprises a heatable hair contact member 225. In embodiments, the hair contact member 225 is heatable by heating element 220. In alternative embodiments, the hair contact member 225 is heatable directly, i.e. without requiring a separate heating element 220. In embodiments, the hair contact member 225 comprises one or more heatable plates. For example, the hair contact member 225 may comprise one or more of the heatable plates 115, 125 described with reference to FIGS. 1A and 1B above. The hair contact member 225 may comprise one or more hair-contactable surfaces, e.g. the hair-contactable surfaces 116, 126 described above. The hair contact member 225 is operable to apply heat to hair via the one or more hair-contactable surfaces 116, 126. As such, the controller 210 controls heating of the hair contact member 225, e.g. by controlling the heating element 220, which causes heat to be delivered to hair in contact with the one or more hair-contactable surfaces 116, 126 of the hair contact member 225.

In embodiments, the hair contact member 225 comprises opposing first and second hair-contactable surfaces 116, 126. The opposing first and second hair-contactable surfaces 116, 126 are arranged to heat hair engaged there-between. In embodiments, the hair contact member 225 is operable to apply heat to hair by movement of the hair contact member 225 along a tress of hair, e.g. from a first end of the tress towards a second end of the tress. Movement of the hair contact member 225 along the tress may be referred to as a 'pass'. The hair contact member 225 may comprise moveable arms, such as the first arm 110 and second arm 120 described with reference to FIGS. 1A and 1B above.

The hairstyling device 100 comprises at least one sensor 230 configured to sense a change in state of the device from a first stationary state to a second moving state. The controller 210 is configured to, in response to the at least one sensor sensing a change in state from the first state to the second state, cause the hair contact member 225 to heat to a pre-determined operating temperature by a pre-determined amount of time after the detected state change. In embodiments, sensing a change in state of the device comprises sensing an acceleration or displacement of the device.

In embodiments, the hairstyling device 100 comprises at least one sensor 230. Examples of such sensors include, but are not limited to, IMUs, proximity sensors such as Hall effect sensors, temperature sensors, humidity sensors, power sensors, proximity sensors, motion sensors, gyroscopes, accelerometers, magnetometers, etc. The controller 210 is operable to receive signals (e.g. sensor output) from the at least one sensor 230. The sensor output from the at least one sensor 230 may be used to control the hairstyling device 100. In embodiments, the controller 210 is operable to control the at least one sensor 230.

In the embodiments shown in FIG. 2, the at least one sensor 230 comprises an IMU 235. In such embodiments, the controller 210 is operable to receive signals from the IMU 235 indicative of movement of the hairstyling device 100. In embodiments, the IMU 235 comprises an accelerometer, a gyroscope and a magnetometer. Each of the accelerometer, gyroscope and magnetometer has three axes, or degrees of freedom (x, y, z). As such, the IMU 235 may comprise a 9-axis IMU. In alternative embodiments, the IMU 235 comprises an accelerometer and a gyroscope, but does not comprise a magnetometer. In such embodiments, the IMU 235 comprises a 6-axis IMU. A 9-axis IMU may produce more accurate measurements than a 6-axis IMU, due to the additional degrees of freedom. However, a 6-axis IMU may be preferable to a 9-axis IMU in some scenarios. For example, some hairstyling devices may cause and/or encounter magnetic disturbances during use. This may be a particular consideration for cordless hairstyling devices, which comprise an on-board power source, as well as hairstyling devices comprising heating elements. Heating, magnetism and/or magnetic inductance on the device and/or other magnetic disturbances can affect the behaviour of the magnetometer. As such, in some cases, a 6-axis IMU is more reliable and/or accurate than a 9-axis IMU. The IMU is configured to output data indicating accelerometer and gyroscope signals (and in some embodiments magnetometer signals). In an alternative embodiment, the IMU 235 may comprise an accelerometer, but does not comprise a gyroscope or a magnetometer. In such an embodiment, the IMU 235 comprises a 3-axis IMU.

In embodiments, the controller 210 is configured to process the sensor output using a velocity and/or position estimation algorithm. In embodiments, the speed/position estimation algorithm merges the accelerometer/gyroscope signals from the IMU. For example, determining that the hair contact member 225 has reached the roots of a user's hair may be performed through use of the velocity and/or position estimation algorithm. In embodiments where a 9-axis IMU is used, the velocity and/or position estimation algorithm can determine the initial state using the signal from the magnetometer in addition to the accelerometer/gyroscope signals. In embodiments, the velocity and/or position algorithm includes a Madgwick filter. The velocity and/or position estimation algorithm may be implemented using software or hardware, e.g. an application specific integrated circuit (ASIC), or may be implemented using a combination of hardware and software. The velocity and/or position estimation algorithm may be used in various methods described herein.

IMUs may suffer from noise and/or, biases and/or drifts which, unless properly corrected for, can cause inaccuracies in the resulting calculations. For example, the gyroscope signals drift over time, the accelerometer may be biased by gravity, and both suffer from noise. In embodiments, some of the noise in the IMU signals is removed using filtering for example high and/or low pass and/or median filters. In embodiments, a Madgwick filter is used to correct for gyroscope drift, by removing the magnitude of the gyroscope measurement error, in the direction or steepest direction of the estimated error, whilst merging the accelerometer and gyroscope signals. The output of the Madgwick filter is a world referenced orientation quaternion or Madgwick quaternion that gives the devices orientation. This quaternion is used to rotate the acceleration signals to the world/earths frame. Once the acceleration is rotated the proportion of gravity's pull on each axis is calculated and removed. This gives linear/motion acceleration, which is integrated to obtain velocity, and then velocity is integrated to obtain position. Each time the signals are integrated, the remaining errors arising from such biases and/or drifts increase. Such errors may therefore be particularly problematic for velocity or position measurements. The drift in the velocity is compensated for before it is integrated to obtain position, which increases the accuracy of the measurements. The velocity and position measurements can be measurements for all 3 axes individually or combined to be velocity magnitude and position magnitude.

Alternative filters may be used instead of, or in addition to, the Madgwick filter, in other embodiments. Examples of such filters include a Kalman filters, extended Kalman filters, and/or Complementary filters such as Mahony filters. However, the Madgwick filter is less computationally expensive than other filters whilst achieving a comparable, or in some cases better, level of accuracy. This allows the Madgwick filter to be run on the hairstyling device 100 itself, rather than requiring an external processing device. This reduces latency compared to a case in which processing is carried out on an external processing data, as the need to transfer data between devices is avoided.

In embodiments, the speed may be determined by processing one or more signals from a 3-axis IMU. As described above, in such embodiments, heating of the hair contact member 225 is controlled based on the determined speed. In embodiments, heating of the hair contact member 225 is controlled to cause the operating temperature of the hair contact member 225 to change (e.g. increase) at a rate dependent on the determined speed. In other words, the rate of temperature change of the hair contact member 225 may be dependent on the speed at which the hair contact member 225 is moving. For example, a rate of temperature increase (or "temperature ramp") may be relatively steep if the hair contact member 225 is determined to be moving relatively quickly, and may be relatively shallow if the hair contact member 225 is determined to be moving relatively slowly. This allows for a finer control of the heat distribution along the tress, and/or enables the hairstyling device 100 to adapt to the user's behaviour. In embodiments, a heat delivery profile along the tress is dependent on the determined speed.

In embodiments, the sensor output is processed using a velocity and/or position estimation algorithm such as a machine learning model. In embodiments, a 3-axis IMU that comprises an accelerometer is used in combination with a machine learning model. For example, determining that the hair contact member 225 is moving along the tress, determining a displacement of the hair contact member 225 from the first end, and/or determining the speed of the hair contact member 225, may be performed through use of the machine learning model.

In embodiments where a 3-axis IMU is used, the machine learning model can determine an initial state using the signal from the 3-axis IMU. In embodiments, the machine learning model has been trained using a generalized nonlinear regression algorithm (such as Gaussian kernel regression and neural networks. The training data for the machine learning model uses 3-axis IMU data from previous uses of the hair styling device 100, along with target data from ground truth source, for example a Vicon motion capture system. It will be appreciated that the target data from a ground truth source can be captured using an alternative system. The machine learning model may be implemented using software or hardware, e.g. an application specific integrated circuit (ASIC), or may be implemented using a combination of hardware and software. The machine learning model may be used in various methods described herein.

As mentioned, the IMU (such as 3-axis IMUs) may suffer from noise, biases and/or drifts which, unless properly corrected for, can cause inaccuracies in the resulting calculations. For example, the accelerometer may be biased by gravity, and the accelerometer signals may suffer from noise. In embodiments, at least some of the noise in the accelerometer signals is removed using filtering, for example high and/or low pass and/or median filters.

In embodiments, a low pass filter is applied to each signal output of the 3-axis IMU to remove noise. Each signal is then combined into a single signal output. The proportion of force on the single signal output due to Gravity is then calculated and subtracted from the signal output to give an acceleration magnitude.

The previously trained machine learning model is then applied to the acceleration magnitude.

The machine learning model as described above is used to correct noise, biases and drift, such as velocity drift, as it simultaneously converts the acceleration magnitude to a velocity magnitude, by using a machine learning model that has been trained as previously described. In embodiments, the machine learning model is trained with motion acceleration magnitude training data and velocity magnitude ground truth data provided in previous uses of the hair styling device, and from a ground truth source for example a Vicon motion capture system.

In embodiments, a sliding window algorithm is used to generate input data for the machine learning model, which in preferred embodiments consists of twenty sample points simultaneously. In doing so, drift is compensated for the twentieth sample point of the calculated velocity by the machine learning model, which has considered that sample point and the previous nineteen sample points of the motion acceleration magnitude input data. However, it will be appreciated that a different number of sample points can be used as input data to the machine learning model. In this regard, the machine learning model can correct and/or compensate for noise, biases and/or drifts associated with the 3-axis IMU.

In an alternative embodiment, a low pass filter is applied to each signal output of the 3-axis IMU. Each of the three signal outputs is then processed separately. The proportion of force on each signal is then calculated and subtracted from each of the signal outputs to give three acceleration magnitudes (one acceleration magnitude per axis). The previously trained machine learning model as described above, is then applied to each acceleration magnitude individually. Similarly, the sliding window algorithm can be applied to generate input for the machine learning model. In other words, the machine learning model and the sliding window algorithm can be applied to each axis individually.

In embodiments, the velocity is integrated to obtain position and/or displacement. Since the drift has been compensated for in the calculated velocity, the position and/or displacement can be determined more accurately.

Therefore, the machine learning model in combination with the 3-axis IMU can be used to compensate for velocity drift and to determine the velocity, the position and/or the displacement of the hair styling device.

In embodiments, the hairstyling device 100 comprises a user interface 240 to facilitate efficient and easy interaction of the user with the device 100. The user interface 240 may comprise an audio and/or visual interface, for example. In embodiments, the user interface 240 comprises a display (for example a touch-screen display). In embodiments, the user interface 240 comprises an audio output device such as a speaker. The controller 210 is operable to control the user interface 240, e.g. to cause the user interface 240 to provide output for a user. In some embodiments, the controller 210 is operable to receive data, e.g. based on user input, via the user interface 240.

In embodiments, the hairstyling device 100 also comprises a memory 250. The memory 250 is operable to store various data according to embodiments. The memory may comprise at least one volatile memory, at least one non-volatile memory, and/or at least one data storage unit. The volatile memory, non-volatile memory and/or data storage unit may be configured to store computer-readable information and/or instructions for use/execution by the controller 210. The memory 250 may store data specific to one user, or data for multiple different users, thereby improving the user's experience when using the device 100.

The hairstyling device 100 may comprise more, fewer and/or different components in alternative embodiments. In particular, at least some of the components of the hairstyling device 100 shown in FIGS. 1A, 1B and/or 2 may be omitted (e.g. may not be required) in some embodiments. For example, at least one of the heating element 220, closing mechanism 227, user interface 240 and memory 250 may be omitted in some embodiments. In some embodiments, the hairstyling device 100 does not comprise the moveable (e.g. pivotable) arms 110, 120.

In embodiments, the controller 210 is configured to cause the hair contact member 225 to start heating when the at least one sensor 225 senses the state change. In embodiments, the hair contact member 225 starts to heat immediately when the at least one sensor 230 senses the state change. In embodiments, the controller is configured to cause the hair contact member 225 to start heating after a pre-determined time delay. In embodiments, the time delay is up to about 2 seconds, for example approximately 0.5 seconds.

In embodiments, the controller 210 is configured to cause the hair contact 225 member to heat at a pre-determined rate. In embodiments, the pre-determined rate is between about 10° C./second and 40° C./second, for example approximately 20° C./second. In embodiments, the hair contact member 225 heats to a pre-determined operating temperature of between about 160 and 210° C., for example approximately 185° C.

In embodiments, at least one of the predetermined amount of time; pre-determined rate; pre-determined time-delay; and pre-determined operating temperature is initially set to a default value. In embodiments, at least one of the pre-determined rate, pre-determined time-delay or pre-determined operating temperature is initially set by the manufacturer. In embodiments, at least one of the pre-determined rate, the pre-determined time-delay or the pre-determined operating temperature is user configurable. In embodiments, a user can input, adjust the pre-determined rate, pre-determined time-delay or pre-determined operating temperature using the user interface, for example, if they wish to override default values set by the manufacturer.

In embodiments, the at least one sensor 230 is configured to output signals dependent on movement of the hairstyling device 100, and the controller 210 is configured to receive the output signals from the at least one sensor 230, identify one or more user operation parameters associated with how a user operates the device; and adapt, on the basis of the one or more identified user parameters, at least one of the: pre-determined amount of time; pre-determined rate; pre-determined time-delay; and the pre-determined operating temperature. This improves the experience of the user, for example, ensuring that the device 100 has reached an appropriate operating temperature by the time they start styling their hair, and ensuring the operating temperature is appropriate for the styling action that they are using. This may also improve the run time of the device 100 by avoiding the device 100 being held at the operating temperature for longer than necessary.

In embodiments, the output signal provides an indication of whether the device 100 is being used to curl or straighten the hair. In embodiments, the user operation parameter provides an indication of the type of styling that is being performed. In embodiments, the controller 210 adapts the operating temperature depending on the type of styling that is being performed by causing the hair contact member 225 to heat or cool to a different temperature. This may avoid a user damaging their hair by using an inappropriate operating temperature, and may help to improve the performance of the device. In embodiments, the output signal provides an indication of the length of time taken for a user to style a tress. In embodiments, the output signal provides an indication of the time between a user picking up the device 100 and starting to style a tress. In embodiments, the controller 210 identifies a temporal parameter indicative of the time between a user picking up the device and starting to style a tress. In embodiments, the controller 210 stores this temporal parameter for future use. In embodiments, the controller adapts the pre-determined rate and/or the pre-determined operating temperature are adapted depending upon the time between a user picking up the device and starting to style a tress. In embodiments, the output signal provides an indication of the length of time that the hair contact member 225 is in contact with a tress and/or the speed at which the hair contact member 225 is moved along a tress. In embodiments, the controller 210 adapts the pre-determined operating temperature based on the length of time that the hair contact member 225 is in contact with a tress and/or the speed at which the hair contact member 225 is moved along the tress.

In embodiments, the controller 210 is configured to identify one or more user operation parameters specific to multiple users, and the adaption is performed on the basis of the user specific operation parameters. This allows multiple different users to use the device 100 and to ensure that the device will operate efficiently for each of them. In embodiments, the device 100 receives an input from a user indicating their identity. In embodiments, the at least one sensor 230 outputs a signal providing an indication of the user's identity. In embodiments, the controller 210 receives a signal from the at least one sensor 230 providing an indication of the user's identity, and the controller 210 identifies a parameter associated with that user. In embodiments, the controller 210 identifies a user specific temporal parameter indicative of the time between a user picking up the device 100 and starting to style a tress. In embodiments, the controller 210 stores this user specific temporal parameter for future use.

In embodiments, the user interface 240 enables a user to input their identity. In response to this, in embodiments the controller 210 adjusts the operating temperature and/or heating race based on a known user specific temporal parameter parameter associated with that user.

In embodiments, the device 100 is wirelessly connected to an electronic device of a user, and the device 100 may receive an input from a user via the electronic device indicating their identity.

In embodiments, the identified one or more user operation parameters comprise one or more of temporal parameters; spatial parameters; and thermal parameters.

In embodiments, the at least one sensor 230 is configured to sense a change in state of the device 100 from the second moving state to the first stationary state, and the controller 210 is configured to, in response to the at least one sensor 230 sensing a change in state from the second state to the first state, prohibit heating of the hair contact member 225, thereby allowing the hair contact member 225 to cool below the pre-determined operating temperature.

In embodiments, prohibiting heating of the hair contact member 225 comprises preventing power from being supplied to the hair contact member 225. In embodiments, prohibiting heating of the hair contact member 225 comprises preventing power from being supplied to a heating element. In embodiments, the hair contact member 225 cools to a standby temperature. In embodiments, the controller maintains the hair contact member 225 at a standby temperature. The standby temperature may be between about 50 and 150° C. In embodiments, the hair contact member 225 may cool to room temperature.

In the embodiments shown in FIG. 2, the at least one sensor 230 comprises a touch sensor 237 configured to sense when a user has picked up the device, and the controller 210 is configured to, in response to the touch sensor 237 sensing that the device is not being held by the user, prevent the hair contact member from heating to the pre-determined operating temperature. In the embodiments shown in FIG. 2, the at least one sensor comprises a proximity sensor 236 configured to sense when a pass has started and finished.

In embodiments, the device 100 comprises at least one other sensor configured to sense one or more environmental conditions, and the controller 210 is configured to cause heating of the hair contact member 225 to the pre-determined operating temperature further on the basis of the sensed environmental conditions. In embodiments, the controller 210 receives a signal that provides an indication of one or more environmental conditions from at least one other sensor 239. In embodiments, the controller 210 adapts the pre-determined operating temperature and/or the pre-determined heating rate on the basis of the one or more environmental conditions. In the embodiments shown in FIG. 2, the device 100 comprises a temperature sensor 239, and the temperature sensor 239 outputs a signal that provides an indication of the temperature of the room in which the device 100 is being operated. In embodiments, the controller 210 receives a signal that provides an indication of the temperature of the room in which the device 100 is being operated and adapts the pre-determined operating temperature and/or pre-determined rate based on the room temperature.

In embodiments, the device 100 comprises a humidity sensor, and the humidity sensor outputs a signal that provides an indication of the humidity level of the room in which the device is being operated. In embodiments, the controller 210 receives a signal that provides an indication of the humidity level of the room in which the device is being operated and adapts the pre-determined operating temperature and/or pre-determined rate based on the humidity level.

In embodiments, the device 100 is configured to receive an input from a user. In embodiments, the user can input a desired operating temperature using the user interface 240, or using an electronic device that is wirelessly connected to the hairstyling device 100. In embodiments, the user can input a desired heating rate. In embodiments, a user can input an intended styling action and, in response to this input, the controller 210 may alter the operating temperature and/or heating rate. In embodiments, a user input can override a pre-determined operating temperature and/or heating rate.

In embodiments, the user can input an indication of their identity using the user interface 240 or a wirelessly connected electronic device, and in response to this indication, the controller 210 may adjust the operating temperature and/or heating rate based on a known parameter associated with that user.

In embodiments, the device 100 may receive an input from a user via the user of interface 240 or a wirelessly connected electronic device indicating their identity. In embodiments, the controller 210 associates the user's identity with a stored parameter associated with that user, and the controller may alter the operating temperature and/or the heating rate.

In embodiments, the device 100 comprises a hair curler. In other embodiments, the hair curler comprises a curved plate or a barrel. A hair curler may comprise a hair contact member in the form of a heatable barrel or curved plate comprising a hair-contactable surface. The hair-contactable surface may be a ceramic or metal curved surface. The hair contactable surface may be an outer surface of a heatable barrel or curved plate. In embodiments, a hair curler comprises an articulated arm for clamping a tress of hair to the hair-contactable surface. In embodiments, a tress may be wrapped around the hair-contactable surface.

Figure 3:
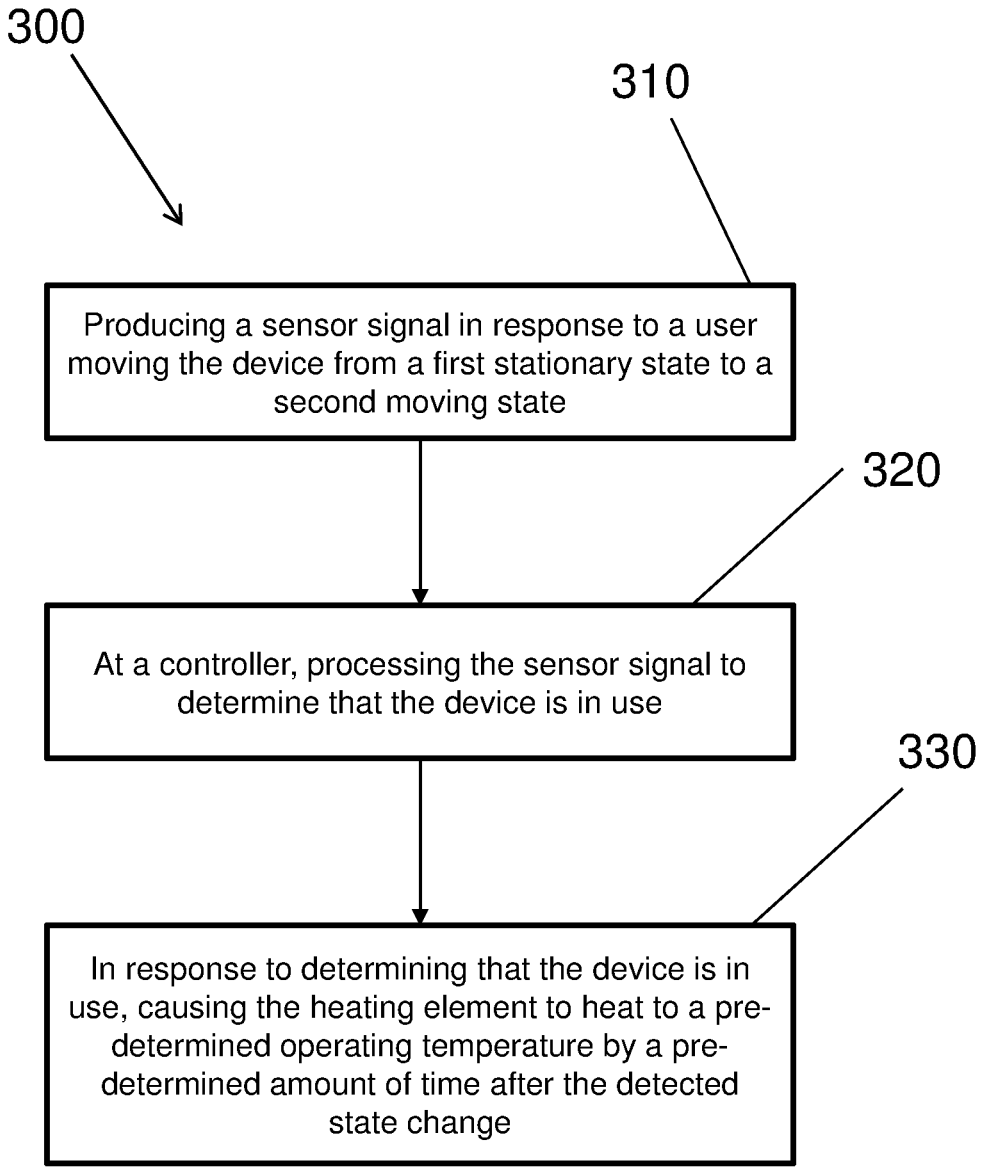
FIG. 3 is a flowchart showing a method of operating a cordless hairstyling device, according to embodiments.

FIG. 3 shows a method 300 of operating a hairstyling device, according to embodiments. The method 300 may be used to operate the hairstyling device 100 described above with reference to FIGS. 1A, 1B and 2. In the embodiments of FIG. 3, the hairstyling device 100 comprises the heatable hair contact member 225 having a hair-contactable surface 116, 126. The hair contact member 225 is operable to apply heat to a tress of hair of a user via the hair-contactable surface 116, 126. In embodiments, the method 300 is performed at least in part by the controller 210.

In step 310, a sensor 230 signal is generated in response to a user moving the device from a first stationary state to a second moving state. In step 320, at the controller 210, the sensor 230 signal is processed to determine that the device 100 is in use. In step 330, in response to determining that the device is in use, the heatable hair contact member 225 is caused to heat to a pre-determined operating temperature by a pre-determined amount of time after the detected state change.

In embodiments, upon first use of the device, the pre-determined operating temperature and the pre-determined amount of time are default settings set by the manufacturer. In embodiments, as a user uses the device 100 to style their hair, the controller 210 receives signals from the IMU sensor 235 that are indicative of a temporal parameter associated with the user. In embodiments, the temporal parameter indicates, for a given user, the time or average time between a user moving a device 100 and starting to style their hair. In embodiments, the controller 210 adapts the pre-determined amount of time, or the heating rate, based on this parameter.

In embodiments, the controller 210 receives sensor signals from the IMU 235 sensor indicating that the device 100 is moving. In embodiments, the controller 210 also receives signals from the touch sensor 237 indicating that the device 100 is being held by a user. In embodiments, if the controller 210 receives a signal from the IMU sensor 235 indicating that the device 100 is moving, but the touch sensor 235 indicates that the device 100 is not being held by a user, the heatable hair contact member 225 will not be caused to heat.

In embodiments, when user begins to style hair using the device 1, the IMU 235 sensor outputs a signal indicating that the user is using the device 100 and indicating the styling action. The controller 210 receives the sensor signal from the IMU 235 sensor, and causes power to be supplied to the heatable hair contact member 225. In embodiments, the heatable hair contact member is heated to a temperature that is suitable for the styling action. In embodiments, the IMU sensor 235 also outputs a second signal indicating that the time between the user moving the device and commencing styling. In embodiments, the proximity sensor 236 outputs a third signal indicating that a pass has started. In embodiments, the controller 210 receives the second signal and identifies a temporal parameter with the user. In embodiments, the controller receives the third signal and uses this third signal to identify the temporal parameter with the user. In embodiments, the temporal parameter is stored by the controller 210 for future reference. In embodiments, the controller 210 adapts the heating rate of the heating element in response to this temporal parameter.

In embodiments, when a pass finishes, the controller 210 receives a signal from the proximity sensor 236 indicating that the hair contact member 225 is not in contact with a tress. In embodiments, when the user finishes styling their hair and puts the device down, the IMU sensor 235 senses that the straightener 100 has been returned to the first stationary state. The controller 210 receives a signal from the IMU sensor 235 indicating that the straightener 1 has been returned to the stationary state. In embodiments, in response to receiving the signal from the IMU sensor 235, the controller 210 stops supplying power to the heatable hair contact member 225, and the heatable hair contact member 225 will cool. In embodiments, in response to receiving the signal from the proximity sensor 236, the controller 210 stops supplying power to the heatable hair contact member 225, and the heatable hair contact member 225 will cool. In embodiments, the heatable hair contact member 225 will cool to room temperature.

In embodiments, the controller 210 also receives a signal from the temperature sensor 239 indicating the current temperature of the room in which the device 100 is being used. In embodiments, the controller 100 also receives a signal from a humidity sensor indicating the humidity level of the room. In embodiments, the controller 210 adapts the operating temperature and heating rate based on the room temperature and/or humidity level.

In embodiments, the next time a user commences styling their hair using the device 100, the controller 210 uses the stored temporal parameter to cause the heatable hair contact member 255 to heat at a rate that is adapted for the user, rather than the default rate. In embodiments, if the IMU sensor 235 senses that, on this occasion, the user is using the device to perform a different styling action (for example, curling rather than heating), the controller 210 receives a signal from the IMU sensor 235 and causes the heatable hair contact member 225 to heat or cool to a different operating temperature, which is a temperature suitable for that styling action. In embodiments, the IMU sensor 235 senses the time between the user moving the device 100 and beginning to style their hair using the new styling action. In embodiments, the IMU sensor 235 outputs a new signal to the controller 210. In embodiments, if the controller 210 determines that the user takes a different amount of time between picking up the device 100 and beginning to style their hair using the different styling action, the controller 210 identifies a second parameter that is associated with the user when the user is using this different styling action. In embodiments, this second parameter is stored by the controller 210 for future use.

In embodiments, prior to commencing styling using the device 100, a user inputs their identity using the user interface 240. In embodiments, as the user uses the device 100 to style their hair, the controller 210 receives a signal from the IMU sensor 235 indicative of the time, or average time, between the user moving the device 100 and beginning to style a tress. In embodiments, the controller 210 identifies a temporal parameter with the identified user. In embodiments, the controller 210 stores this parameter for future use.

In embodiments, if a second, different user is going to use the device 100 to style their hair they input their identity using the user interface 240 prior to commencing styling. In embodiments, if the IMU sensor 235 senses that the second user takes a different amount of time between moving the device and beginning to style their hair, the IMU sensor 235 outputs a second signal to the controller. In embodiments, the controller identifies a second, different temporal parameter associated with the second user. In embodiments, this second parameter is stored for future use.

In embodiments, if either of the first or second users uses the device 100 to style their hair on a future occasion, before commencing styling, they can input their identity to the device 100 using the user interface 240. In embodiments, if the controller 210 recognises that the user is a known user, and if the controller 210 has a stored parameter associated that user, the controller 210 uses the identified temporal parameter associated with that user to adjust the heating rate of the heatable plate to be appropriate for that user.

In embodiments of the present disclosure, the hairstyling device 100 comprises a controller 210. The controller 210 is configured to perform various methods described herein. In embodiments, the controller comprises a processing system. Such a processing system may comprise one or more processors and/or memory. Each device, component, or function as described in relation to any of the examples described herein, for example the at least one sensor 230, user interface 240, may similarly comprise a processor or may be comprised in apparatus comprising a processor. One or more aspects of the embodiments described herein comprise processes performed by apparatus. In some examples, the apparatus comprises one or more processors configured to carry out these processes. In this regard, embodiments may be implemented at least in part by computer software stored in (non-transitory) memory and executable by the processor, or by hardware, or by a combination of tangibly stored software and hardware (and tangibly stored firmware). Embodiments also extend to computer programs, particularly computer programs on or in a carrier, adapted for putting the above described embodiments into practice. The program may be in the form of non-transitory source code, object code, or in any other non-transitory form suitable for use in the implementation of processes according to embodiments. The carrier may be any entity or device capable of carrying the program, such as a RAM, a ROM, or an optical memory device, etc.

The one or more processors of processing systems may comprise a central processing unit (CPU). The one or more processors may comprise a graphics processing unit (GPU). The one or more processors may comprise one or more of a field programmable gate array (FPGA), a programmable logic device (PLD), or a complex programmable logic device (CPLD). The one or more processors may comprise an application specific integrated circuit (ASIC). It will be appreciated by the skilled person that many other types of device, in addition to the examples provided, may be used to provide the one or more processors. The one or more processors may comprise multiple co-located processors or multiple disparately located processors. Operations performed by the one or more processors may be carried out by one or more of hardware, firmware, and software. It will be appreciated that processing systems may comprise more, fewer and/or different components from those described.

The techniques described herein may be implemented in software or hardware, or may be implemented using a combination of software and hardware. They may include configuring an apparatus to carry out and/or support any or all of techniques described herein. Although at least some aspects of the examples described herein with reference to the drawings comprise computer processes performed in processing systems or processors, examples described herein also extend to computer programs, for example computer programs on or in a carrier, adapted for putting the examples into practice. The carrier may be any entity or device capable of carrying the program. The carrier may comprise a computer readable storage media. Examples of tangible computer-readable storage media include, but are not limited to, an optical medium (e.g., CD-ROM, DVD-ROM or Blu-ray), flash memory card, floppy or hard disk or any other medium capable of storing computer-readable instructions such as firmware or microcode in at least one ROM or RAM or Programmable ROM (PROM) chips.

Where in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the present disclosure that are described as preferable, advantageous, convenient or the like are optional and do not limit the scope of the independent claims. Moreover, it is to be understood that such optional integers or features, whilst of possible benefit in some embodiments of the present disclosure, may not be desirable, and may therefore be absent, in other embodiments.

The invention claimed is:

1. A cordless hairstyling device, the device comprising:

a heatable hair contact member having a hair contact-able surface, the hair contact member being operable to apply heat to a tress of hair of a user via the hair contactable surface;

at least one sensor configured to sense a change in state of the device from a first stationary state to a second moving state; and a controller configured to, in response to the at least one sensor sensing a change in state from the first state to the second state, cause the hair contact member to heat to a pre-determined operating temperature by a pre-determined amount of time after the detected state change.

2. The cordless hairstyling device according to claim 1, wherein the controller is configured to cause the hair contact member to start heating when the at least one sensor senses the state change.

3. The cordless hairstyling device according to claim 1, wherein the controller is configured to cause the hair contact member to start heating after a pre-determined time delay.

4. The cordless hairstyling device according to claim 1, wherein the controller is configured to cause the hair contact member to heat at a pre-determined rate.

5. The cordless hairstyling device according to claim 1, wherein at least one of the:

pre-determined amount of time;

pre-determined rate;

pre-determined time-delay; and pre-determined operating temperature is initially set to a default value.

6. The cordless hairstyling device according to claim 1, wherein the at least one sensor is configured to output signals dependent on movement of the hairstyling device, wherein the controller is configured to;

receive the output signals from the at least one sensor, identify one or more user operation parameters associated with how a user operates the device; and adapt, on the basis of the one or more identified user operation parameters, at least one of the:

pre-determined amount of time;

pre-determined rate;

pre-determined time-delay; and the pre-determined operating temperature.

7. The cordless hairstyling device according to claim 6, wherein the controller is configured to identify one or more user operation parameters specific to multiple users, and wherein the adaption is performed on the basis of the user specific operation parameters.

8. The cordless hairstyling device according to claim 6, wherein the identified one or more user operation parameters comprise one or more of:

temporal parameters;

spatial parameters; and thermal parameters.

9. The cordless hairstyling device according to claim 1, wherein:

the at least one sensor is configured to sense a change in state of the device from the second moving state to the first stationary state, and wherein the controller is configured to, in response to the at least one sensor sensing a change in state from the second state to the first state, prohibit heating of the hair contact member, thereby allowing the heating element to cool below the pre-determined operating temperature.

10. The cordless hairstyling device according to claim 1, wherein the at least one sensor comprises a touch sensor configured to sense when a user has picked up the device, wherein the controller is configured to, in response to the touch sensor sensing that the device is not being held by the by the user, prevent the hair contact member from heating to the pre-determined operating temperature.

11. The cordless hairstyling device according to claim 1, wherein the at least one sensor comprises an inertial measurement unit, IMU, sensor, configured to sense when the device is in the second moving state.

12. The cordless hairstyling device according to claim 1, comprising at least one other sensor configured to sense one or more environmental conditions, and wherein the controller is configured to cause heating of the hair contact member to the pre-determined operating temperature further on the basis of the sensed environmental conditions.

13. The cordless hairstyling device according to claim 12, wherein the environmental conditions comprise temperature and/or humidity of a room in which the device is being operated.

14. The cordless hairstyling device according to claim 1, wherein the pre-determined operating temperature is user-configurable.

15. The cordless hairstyling device according to claim 1, wherein the device comprises a hair straightener.

16. The cordless hairstyling device according to claim 1, wherein the device comprises a hair curler.

17. The hairstyling device according to claim 1, wherein the hairstyling device comprises a heating element operable to heat the hair contact member, and wherein the controller is configured to control the heating element to cause the heating element to heat to a pre-determined operating temperature by a pre-determined amount of time after the detected state change.

18. The cordless hairstyling device according to claim 1, wherein the hair contact member is operable to apply heat to a tress of hair via the hair-contactable surface by movement of the contact member along the tress of hair between a hair-root end of the tress and a hair-tip end of the tress.

19. A method of operating a cordless hairstyling device, the method comprising:

generating a sensor signal in response to a user moving the device from a first stationary state to a second moving state;

at a controller, processing the sensor signal to determine that the device is in use and in response to determining that the device is in use, causing a heatable hair contact member to heat to a pre-determined operating temperature by a pre-determined amount of time after the detected state change.

20. A non-transitory computer-readable medium having a computer program stored thereon comprising a set of instructions, which, when executed by a computerized device, cause the computerized device to perform a method of facilitating use of a cordless hairstyling device, the method comprising: generating a sensor signal in response to a user moving the device from a first stationary state to a second moving state; at a controller, processing the sensor signal to determine that the device is in use; and in response to determining that the device is in use, causing a heatable hair contact member to heat to a pre-determined operating temperature by a pre-determined amount of time after the detected state change.

* * * * *